US012460887B2

(12) United States Patent
Roe

(10) Patent No.: US 12,460,887 B2
(45) Date of Patent: Nov. 4, 2025

(54) SUPPRESSOR

(71) Applicant: Shadow Systems LLC, Plano, TX (US)

(72) Inventor: Richard Trevor Simpson Roe, Plano, TX (US)

(73) Assignee: Shadow Systems LLC, Plano, TX (US)

( * ) Notice: Subject to any disclaimer, the term of this patent is extended or adjusted under 35 U.S.C. 154(b) by 14 days.

(21) Appl. No.: 18/515,943

(22) Filed: Nov. 21, 2023

(65) Prior Publication Data

US 2025/0130004 A1 Apr. 24, 2025

Related U.S. Application Data

(60) Provisional application No. 63/545,315, filed on Oct. 23, 2023.

(51) Int. Cl.
*F41A 21/30* (2006.01)

(52) U.S. Cl.
CPC ..... *F41A 21/30* (2013.01)

(58) Field of Classification Search
CPC ..... F41A 21/30–38
USPC ..... 89/14.2–14.4; 181/223
See application file for complete search history.

(56) References Cited

U.S. PATENT DOCUMENTS 5,050,480 A * 9/1991 Knight, Jr. ..... F41A 17/66 D22/104
7,328,645 B1 * 2/2008 Curry ..... F41A 21/36 42/1.06
8,272,306 B1 * 9/2012 Smith ..... F41A 21/30 89/14.4
10,436,536 B2 * 10/2019 Brittingham ..... F41A 21/34
10,605,558 B1 * 3/2020 Marfione ..... F41A 21/30
10,852,091 B1 * 12/2020 Helms ..... F41A 21/30
10,969,188 B1 * 4/2021 Cottingham ..... F41A 21/30
2012/0272818 A1 * 11/2012 Dueck ..... F41A 21/30 29/896.2
2014/0299405 A1 * 10/2014 Miller ..... F41A 21/30 181/223
2016/0209150 A1 * 7/2016 Smith ..... F41A 21/30
2017/0205178 A1 * 7/2017 Niswander ..... F41A 21/325
2017/0261281 A1 * 9/2017 Salvador ..... F41A 21/325
2018/0347931 A1 * 12/2018 Schoppman ..... F41A 21/36
2022/0034620 A1 * 2/2022 Parker ..... F41A 21/34
2022/0341706 A1 * 10/2022 Dwyer ..... F41G 11/003

* cited by examiner

*Primary Examiner* — Troy Chambers
*Assistant Examiner* — Benjamin S Gomberg
(74) *Attorney, Agent, or Firm* — Spencer Fane LLP; Steven J. Laureanti

(57) ABSTRACT

A suppressed firearm can include a firearm including a slide; and a suppressor configured to mount to the firearm, the suppressor including a suppressor cap, the suppressor cap defining at least one protuberance configured to rotationally interlock with the slide. A suppressor cap can include a flange defining a through hole, the through hole defining an axis; a first lug extending axially outward from the flange, the first lug defining a first radially inner surface; and a second lug extending axially outward from the flange, the second lug defining a second radially inner surface positioned parallel to the first radially inner surface, the axis centered between the first radially inner surface and the second radially inner surface.

17 Claims, 7 Drawing Sheets

SUPPRESSOR

CROSS-REFERENCE

This application claims the benefit of U.S. Provisional Patent Application No. 63/545,315, filed on Oct. 23, 2023, the entire contents of which are expressly incorporated herein by reference.

TECHNICAL FIELD

This disclosure relates to a suppressor. More specifically, this disclosure relates to a suppressor for a firearm.

BACKGROUND

Discharging a firearm produces an extremely loud report that can damage the hearing of nearby persons and disrupt the surrounding environment. Suppressors, or silencers, are sometimes used to attenuate the report. Over time, suppressors slowly accumulate lead, copper, carbon, and other heavy metal deposits, which can eventually diminish the performance of the suppressor. Some suppressors are user-serviceable, which allows a user to disassemble the suppressor for cleaning. One common design for user-serviceable suppressors is to provide a suppressor cap that is threadedly connected to a tube of the suppressor. The suppressor cap can be unscrewed from the tube to remove the suppressor baffles, and the suppressor cap, the baffles, the tube, and any other suppressor components can then be accessed for cleaning. Some suppressors are modular and can be reconfigured in different lengths. For example, some suppressors utilize a tube with two or more pieces, and the suppressor can be shortened by removing the suppressor cap, taking out one piece of the tube and at least one baffle, and screwing the suppressor cap onto the remaining portion of the tube.

Tightening and untightening the suppressor cap and the tube commonly requires a tool to apply sufficient torque to secure the suppressor cap to the tube. Often, these tools are proprietary or of a relatively uncommon design, which can make replacement difficult if the tools are lost. Additionally, threaded connections in suppressors can work loose during use as the suppressor heats up, particularly where dissimilar metals are utilized. This may occur at a time wherein the user may not have access to the necessary tools to re-tighten the suppressor cap and/or the mount, such as if the user is in the field, on a mission, etc.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one exemplary aspect, a suppressed firearm can comprise a firearm comprising a slide; and a suppressor configured to mount to the firearm, the suppressor comprising a suppressor cap, the suppressor cap defining at least one protuberance configured to rotationally interlock with the slide. In a further exemplary aspect, the suppressor can define a first end and a second end; the suppressor cap can be positioned at the first end; the second end can be configured to mount to the firearm; an axis can extend from the first end to the second end; and the at least one protuberance can be configured to rotationally interlock with the slide about the axis.

In a further exemplary aspect, the at least one protuberance can comprise a first lug and a second lug; and a distance between the first lug and the second lug can be sized complimentary to an outer rail width of the slide. In a further exemplary aspect, the slide can define an inner rail width; the at least one protuberance can further comprise a third lug and a fourth lug; and the third lug and the fourth lug can each define a width that is sized complimentary to the inner rail width. In a further exemplary aspect, the slide can define an inner rail width; the at least one protuberance can further comprise a center lug; and the center lug can define a center lug width that can be sized complimentary to the inner rail width.

In another exemplary aspect, a suppressor cap can comprise a flange defining a through hole, the through hole defining an axis; a first lug extending axially outward from the flange, the first lug defining a first radially inner surface; and a second lug extending axially outward from the flange, the second lug defining a second radially inner surface positioned parallel to the first radially inner surface, the axis centered between the first radially inner surface and the second radially inner surface. In a further exemplary aspect, the first radially inner surface and the second radially inner surface can be planar. In a further exemplary aspect, the flange can define a circumference, and the first lug and the second lug can be positioned adjacent to the circumference.

In a further exemplary aspect, a distance between the first radially inner surface and the second radially inner surface can be between 0.848 inches and 0.893 inches. In a further exemplary aspect, the suppressor cap can further comprise a third lug and a fourth lug; the third lug can define a third radially inner surface; the fourth lug can define a fourth radially inner surface; and a distance between the third radially inner surface and the fourth radially inner surface can be between 0.985 inches and 1.030 inches. In a further exemplary aspect, the third radially inner surface can be perpendicular to the first radially inner surface.

In a further exemplary aspect, a distance between the first radially inner surface and the second radially inner surface can be between 0.985 inches and 1.030 inches. In a further exemplary aspect, the first lug can define a width between 0.764 inches and 0.809 inches. In a further exemplary aspect, the first lug can define a width between 0.632 inches and 0.677 inches. In a further exemplary aspect, a distance between the first radially inner surface and the second radially inner surface can be between 0.843 inches and 0.888 inches. In a further exemplary aspect, a distance between the first radially inner surface and the second radially inner surface can be between 1.100 inches and 1.145 inches. In a further exemplary aspect, the first lug can define a width between 0.768 inches and 0.814 inches.

In another exemplary aspect, a method of removing a suppressor cap of a suppressor can comprise engaging a slide of a firearm with at least one protuberance of the suppressor cap to rotationally interlock the slide to the suppressor cap about an axis, the suppressor cap defining a through hole centered about the axis; and rotating the slide about the axis to rotate the suppressor cap about the axis relative to a tube of the suppressor. In a further exemplary aspect, engaging the slide of the firearm with at least one protuberance of the suppressor cap can comprise positioning the slide at least partially between a first lug and a second lug of the at least one protuberance. In a further exemplary aspect, a distance between the first lug and the second lug can be sized complimentary to an outer rail width of the slide. In a further exemplary aspect, the distance can be between 0.848 inches and 0.893 inches. In a further exemplary aspect, the distance can be between 0.985 inches and 1.030 inches. In a further exemplary aspect, positioning the slide at least partially between the first lug and the second lug can comprise positioning a pair of frame rails of the slide between the first lug and the second lug.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
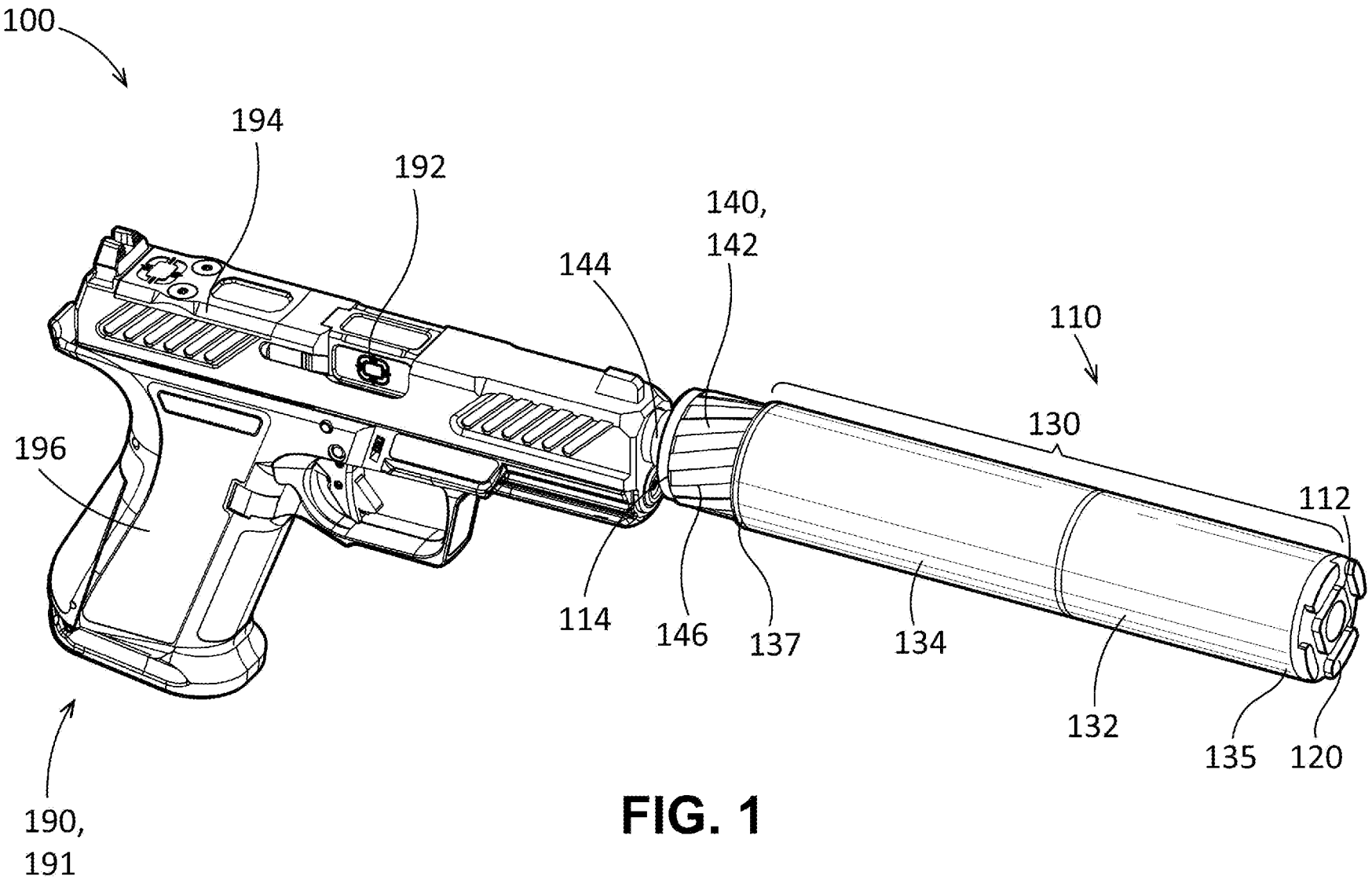
FIG. 1 is a perspective view of a suppressed firearm comprising a firearm and a suppressor in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed, that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a suppressed firearm and associated methods, systems, devices, and various apparatus. The suppressed firearm can comprise a suppressor and a firearm. It would be understood by one of skill in the art that the suppressed firearm is described in but a few exemplary aspects among many. No particular terminology or description should be considered limiting on the disclosure or the scope of any claims issuing therefrom.

FIG. 1 is a perspective view of a suppressed firearm 100 comprising a suppressor 110 and a firearm 190 in accordance with one aspect of the present disclosure.

Figure 4:
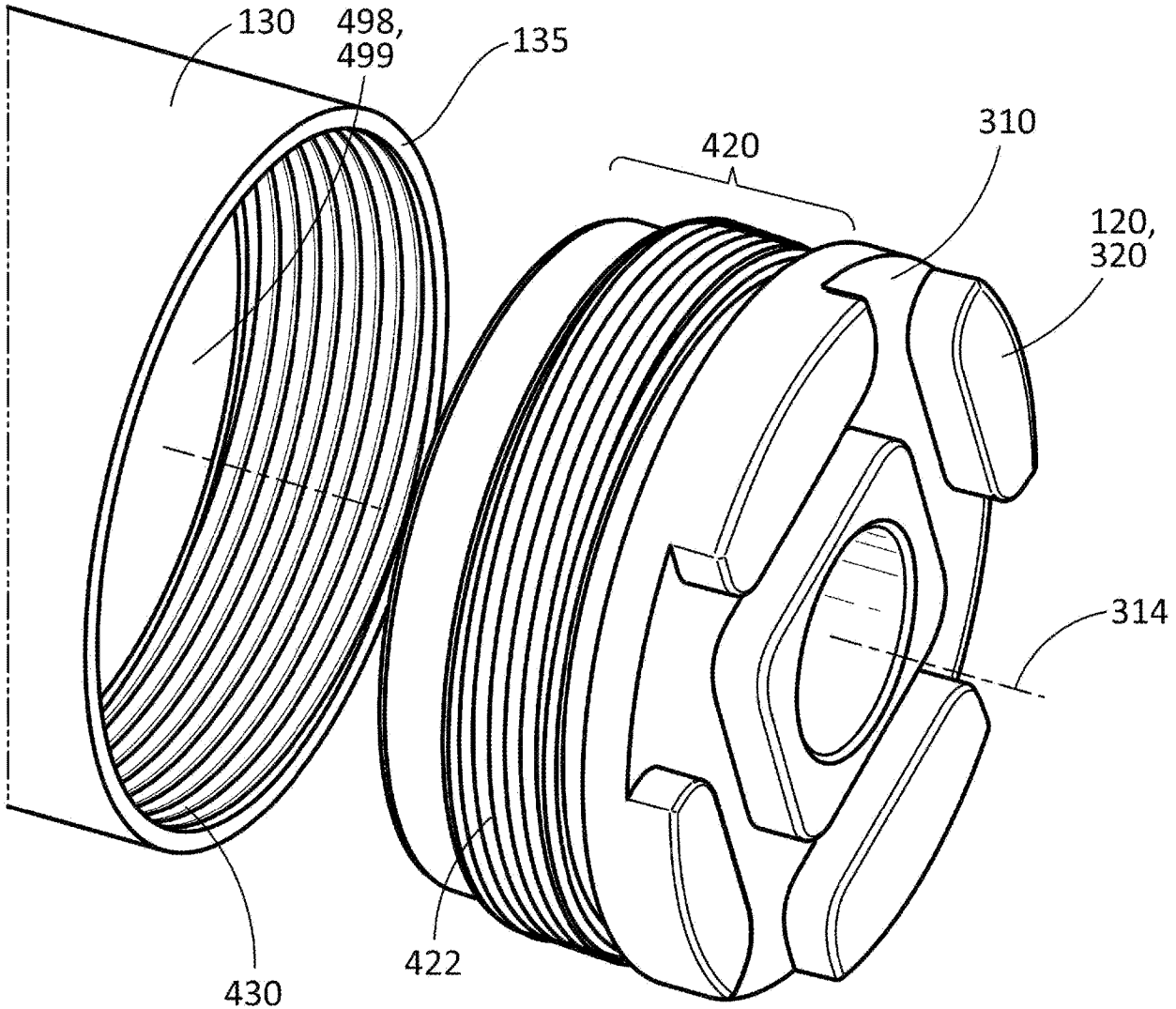
FIG. 4 is a perspective view of the suppressor cap removed from a tube of the suppressor of FIG. 1.

The suppressor 110, also sometimes referred to as a "silencer," can comprise a suppressor cap 120, a tube 130, a mount 140, and at least one flow restricting element 498 (shown in FIG. 4).

The suppressor cap 120 can be coupled to the tube 130. The mount 140 can be coupled to the tube 130 opposite from the suppressor cap 120. The at least one flow restricting element 498 can be positioned within the tube 130 between the suppressor cap 120 and the mount 140. For example and without limitation, the at least one flow restricting element 498 can comprise a plurality of baffles 499 (shown in FIG. 4).

In the aspect shown, the suppressor 110 can be a modular suppressor, and the tube 130 can comprise a first tube portion 132 and a second tube portion 134. The first tube portion 132 can define a first tube end 135 of the tube 130, which can be coupled to the suppressor cap 120. The second tube portion 134 can define a second tube end 137 of the tube 130, which can be coupled to the mount 140. The first tube portion 132 can be coupled to the second tube portion 134. In various aspects, the first tube portion 132 can be threadedly engaged with the second tube portion 134. In modular aspects, a length of the suppressor 110 can be varied by omitting the first tube portion 132 or the second tube portion 134. For example and without limitation, the first tube portion 132 can be omitted, and the suppressor cap 120 can be coupled to the second tube portion 134, or the second tube portion 134 can be omitted, and the mount 140 can be coupled to the first tube portion 132.

In some aspects, the tube 130 can be a one-piece tube. In some aspects, the suppressor 110 can be a "tubeless" design, and the tube 130 can be defined by one or more outer circumferential walls of the at least one flow restricting element 498. In some aspects, the tube 130 can be collectively defined by outer circumferential walls of the baffles 499.

The mount 140 can couple the suppressor 110 to the firearm 190. In the present aspect, the mount 140 can couple the suppressor 110 to a barrel 192 of the firearm 190. In various aspects, the mount 140 can couple the suppressor 110 to a different portion of the firearm 190. In the aspect shown, the mount 140 can be a piston assembly 142, sometimes referred to as a "booster assembly" or a "Nielsen device." The piston assembly 142 can comprise a piston 144, a piston housing 146, and a biasing member (not shown). The piston 144 can be coupled to the barrel 192. The piston 144 can be configured to reciprocate relative to the piston housing 146 when the firearm 190 is fired with the suppressor 110 coupled thereto. In some aspects, the mount 140 can be a different type of mount, such as a direct-thread mount, a tri-lug mount, a bi-lock mount, a taper mount, a snap-on mount, a gate-latch mount, or any other suitable type of mount.

In the present aspect, the firearm 190 can be a handgun 191. In addition to the barrel 192, the handgun 191 can comprise a slide 194, and a frame 196. The slide 194 can be coupled to the frame 196, and the slide 194 can be configured to reciprocate relative to the frame 196.

The barrel 192 can be at least partially positioned within the slide 194. In some aspects, the barrel 192 can be configured to reciprocate relative to the frame 196 during firing of the firearm 190. In some aspects, the barrel 192 can be fixed to the frame 196 and may remain stationary relative to the frame 196 during firing of the firearm 190.

Figure 2:
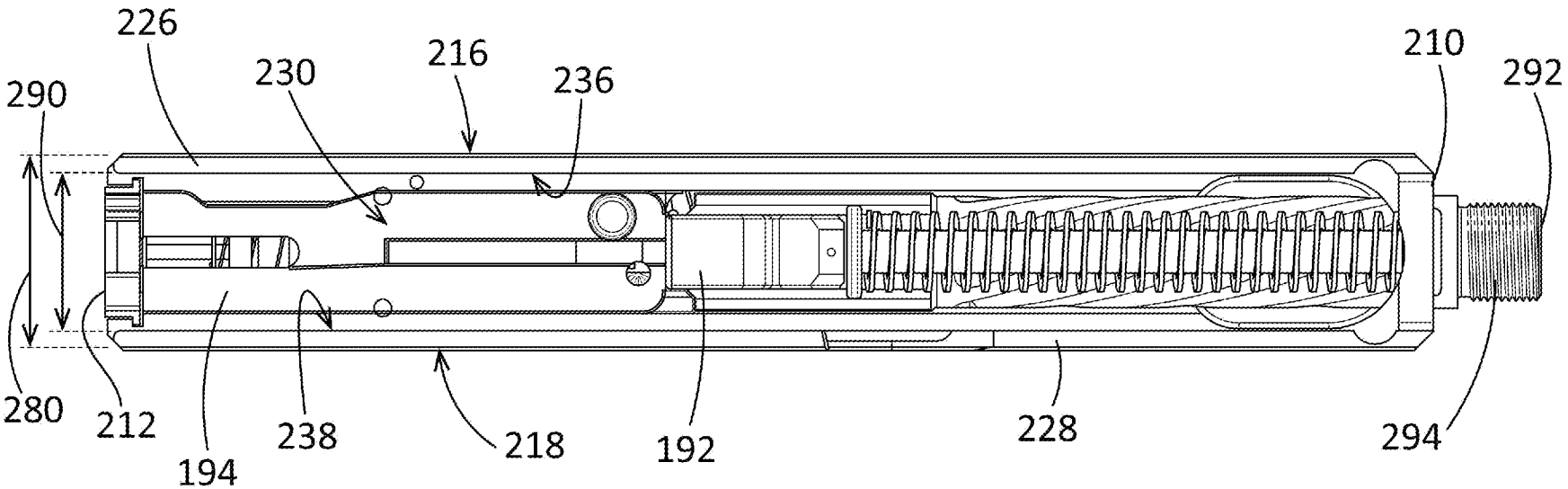
FIG. 2 is a bottom view of a slide and a barrel of the firearm of FIG. 1.

FIG. 2 is a bottom view of the barrel 192 and the slide 194 of the firearm 190 of FIG. 1.

The slide 194 can define a first end 210 and a second end 212. The second end 212 can be positioned opposite from the first end 210. The slide 194 can define a first slide rail 226 and a second slide rail 228, which can each extend at least partially between the first end 210 and the second end 212. The slide rails 226,228 can cooperate with corresponding features of the frame 196 (frame 196 shown in FIG. 1), such as frame rails, lugs, tabs, or other suitable features, to couple the slide 194 to the frame 196.

The first slide rail 226 can define a first outer surface 216 and a first inner surface 236. The second slide rail 228 can define a second outer surface 218 and a second inner surface 238. The slide 194 can define an outer rail width 280, which can be measured between the first outer surface 216 and the second outer surface 218. The slide 194 can define an inner rail width 290, which can be measured between the first inner surface 236 and the second inner surface 238.

The outer rail width 280 and the inner rail width 290 can vary for different examples of the firearm 190 (shown in FIG. 1). The manufacturer of the firearm, the magazine configuration of the firearm 190, and the caliber for which the firearm 190 is chambered can affect these dimensions. For example and without limitations, firearms 190 with double-stack magazines often have larger slide dimensions, such as the outer rail width 280 and/or inner rail width 290 than firearms 190 of the same caliber that utilize single-stack magazines. While there are many different cartridges for which the firearm 190 can be chambered, the most common service cartridges for examples of the handgun 191 (shown in FIG. 1) are 9 mm, .40 Smith and Wesson ("S&W"), and .45 automatic Colt pistol ("ACP"). Examples of the firearm 190 chambered in 9 mm and .40 S&W often have the same dimensions for the slide 194, whereas examples of firearms 190 chambered in .45 ACP often have larger outer rail widths 280 and inner rail widths 290 than those chambered in 9 mm and/or .40 S&W for a given magazine configuration (i.e. a .45 ACP, double-stack example of the firearm 190 will generally be larger in outer rail width 280 and inner rail width 290 than a 9 mm or .40S&W double-stack example of the firearm 190. These dimensions can also vary between manufacturers of similar examples of firearms 190.

For example, on the MR920 pistol made by Shadow Systems LLC of Plano, TX, the outer rail width can be approximately 1.000", and the inner rail width can be approximately 0.7935". On the CR920 pistol made by Shadow Systems, the outer rail width can be approximately 0.863", and the inner rail width can be approximately 0.657". On the G20 10 mm and/or G21 .45 ACP pistols made by Glock Ges.m.b.H. of Deutsch-Wagram, Austria, the outer rail width can be approximately 1.120", and the inner rail width can be approximately 0.7935". On the Universelle Selbstladepistole ("USP") 9 mm and .45 ACP pistols made by Heckler & Koch GmbH of Oberndorf, Germany, the outer rail width can be approximately 1.140", and the inner rail width can be approximately 0.906". On the P2000 pistol made by Heckler & Koch GmbH of Oberndorf, Germany, the outer rail width can be approximately 1.135", and the inner rail width can be approximately 0.906". On the M&P 9 M2.0 Compact pistol made by Smith & Wesson of Springfield, Massachusetts, the outer rail width can be approximately 1.100", and the inner rail width can be approximately 0.785". On the P365 pistol made by SIG SAUER, Inc. of Newington, New Hampshire, the outer rail width can be approximately 0.898", and the inner rail width can be approximately 0.638". On the U.S. military Model 1911, the outer rail width can be approximately 0.912", and the inner rail width can be approximately 0.628".

The slide 194 can define a channel 230 between the slide rails 226,228. The barrel 192 can be at least partially positioned within the channel 230. A muzzle end 292 of the barrel 192 can extend outwards from the first end 210 of the slide 194. The barrel 192 can be configured to couple to the mount 140 (mount 140 shown in FIG. 1). For example and without limitation, the barrel 192 can define threading 294 at or adjacent to the muzzle end 292, which can be complimentary to threading (not shown) defined by the mount 140. For example and without limitation, the threading 294 can threadedly engage with the piston 144 to couple the firearm 190 to the suppressor 110 (suppressor 110 shown in FIG. 1). In some aspects, the muzzle end 292 can be defined by an adaptor (not shown) of the barrel 192. For example and without limitation, the barrel 192 can comprise a tri-lug adaptor, a bi-lock adaptor, a taper mount adaptor, or any other suitable type of adaptor. In some aspects, the adaptor can be integrally formed as part of the barrel 192. In some aspects, the barrel 192 can define can define one or more grooves configured to engage with the mount 140, such as when the mount 140 is a snap-on mount or gate-latch mount for example and without limitation.

Figure 3:
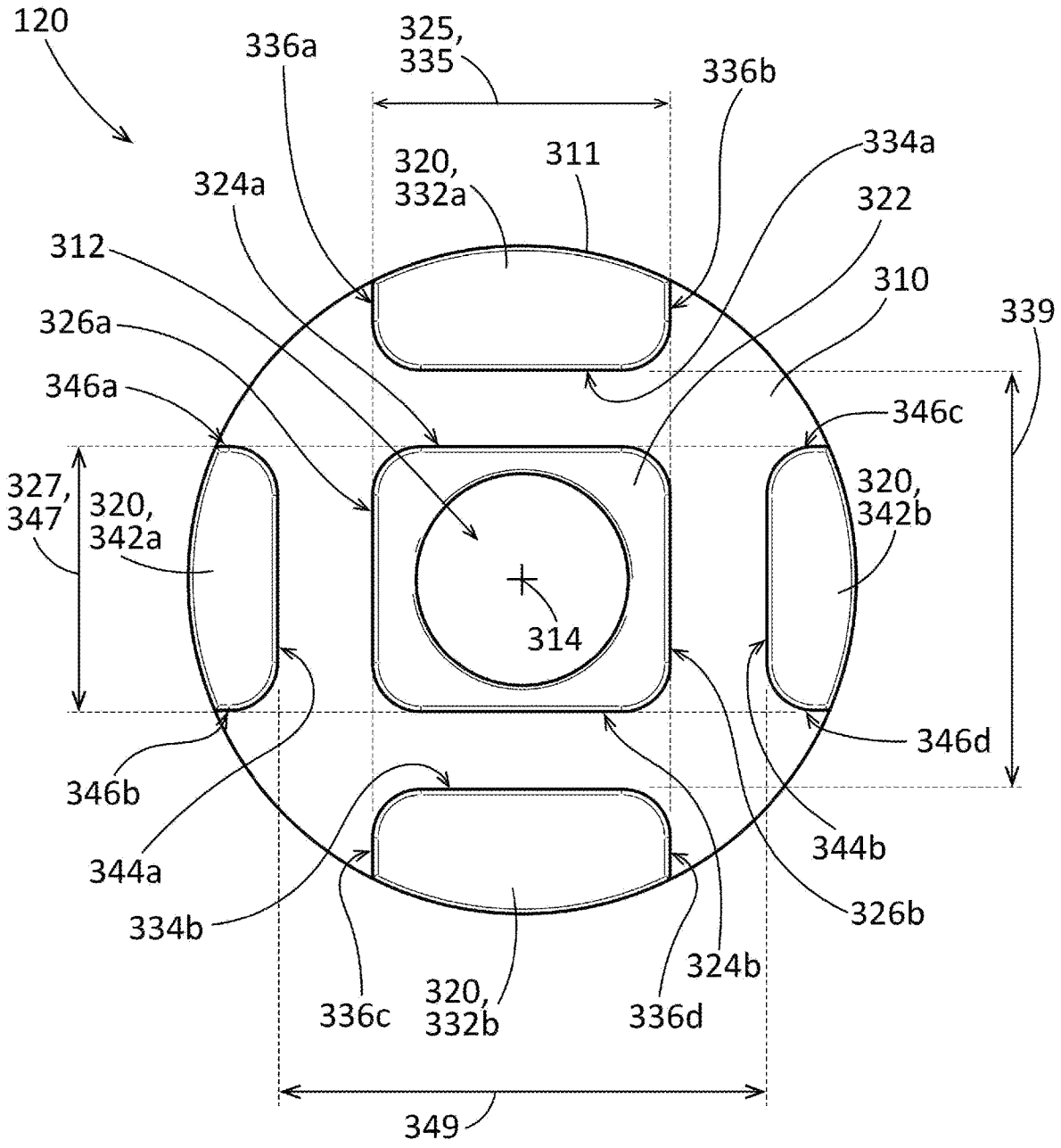
FIG. 3 is an end view of a suppressor cap of the suppressor of FIG. 1.

FIG. 3 is an end view of the suppressor cap 120 of FIG. 1.

The suppressor cap 120 can comprise a flange 310 and at least one protuberance 320. The flange 310 can define a through hole 312, which can be sized to permit a bullet to pass through. For example and without limitation, the through hole 312 can be sized to permit a 9 mm, .40-caliber, or .45-caliber bullet to pass through. The through hole 312 can define an axis 314 (shown extending out of the page). The at least one protuberance 320 can extend axially outward from the flange 310 with respect to the axis 314.

The at least one protuberance 320 can comprise a plurality of lugs. In some aspects, the at least one protuberance 320 can comprise a center lug 322. In some aspects, the at least one protuberance 320 can comprise a first pair of lugs 332*a,b*. In some aspects, the at least one protuberance 320 can further comprise a second pair of lugs 342*a,b*. In some aspects, the at least one protuberance 320 can comprise additional pairs of lugs (not shown).

The center lug 322 can define a first pair of radially outer surfaces 324*a,b* and a second pair of radially outer surfaces 326*a,b*. The first pair of radially outer surfaces 324*a,b* can be parallel to one another. The second pair of radially outer surfaces 326*a,b*, can be parallel to one another. The first pair of radially outer surfaces 324*a,b* can be perpendicular to the second pair of radially outer surfaces 326*a,b*. The axis 314 can be parallel to each of the radially outer surfaces 326*a,b*. The center lug 322 can define a first width 324 measured between the first pair of radially outer surfaces 324*a,b* and a second width 326 measured between second pair of radially outer surfaces 326*a,b*. In some aspects, the first width 324 can be equivalent to the second width 326. In some aspects, the first width 324 can be longer or shorter than the second width 326.

The first pair of lugs 332*a,b* can respectively define a first pair of radially inner surfaces 334*a,b*. A first lug 332*a* of the first pair of lugs 332*a,b* can define a pair of side surfaces 336*a,b*. A second lug 332*b* of the first pair of lugs 332*a,b* can define a pair of side surfaces 336*c,d*. The side surfaces 336*a,c* can be parallel to the side surfaces 336*b,d*. The side surfaces 336*a,b,c,d* can be perpendicular to the first pair of radially inner surfaces 334*a,b*. In some aspects comprising the center lug 322, a third width 335 measured between the side surfaces 336*a,b,c,d*, can be equivalent to the first width 325.

A first distance 339 can be defined between the first pair of radially inner surfaces 334*a,b*.

The second pair of lugs 342*a,b* can respectively define a second pair of radially inner surfaces 344*a,b*. A first lug 342*a* of the first pair of lugs 342*a,b* can define a pair of side surfaces 346*a,b*. A second lug 342*b* of the first pair of lugs 342*a,b* can define a pair of side surfaces 346*c,d*. The side surfaces 346*a,c* can be parallel to the side surfaces 346*b,d*. The side surfaces 346*a,b,c,d* can be perpendicular to the second pair of radially inner surfaces 344*a,b*. In some aspects comprising the center lug 322, a fourth width 347 measured between the side surfaces 346*a,b,c,d*, can be equivalent to the second width 327.

A second distance 349 can be defined between the second pair of radially inner surfaces 344*a,b*. In various aspects, the second distance 349 can be the same as or different from the first distance 339.

In various aspects, some or all of the surfaces 324*a,b*, 326*a,b*,334*a,b*,336*a-d*,344*a,b*,346*a-d* can be substantially planar.

In the present aspect, the various lugs 332*a,b*,334*a,b* can be evenly distributed along, or adjacent to, a circumference 311 of the flange 310. In the aspect shown, the first pair of lugs 332*a,b* can be offset by ninety degrees about the axis 314 from the second pair of lugs 342*a,b*. For example and without limitation, the first pair of radially inner surfaces 334*a,b* can be perpendicular to the second pair of radially inner surfaces 344*a,b*. In aspects with more than two pairs of lugs, the pairs of lugs can be offset at a different angle. For example and without limitation, in an aspect with three pairs of lugs, each pair of lugs can be offset from the next by sixty degrees about the axis 314.

The various widths 325,327,335,347 and/or distances 339,349 can be sized complimentary to at least one dimension of the slide 194 of at least one example of the firearm 190 (slide 194 and firearm 190 shown in FIG. 1) so that the slide 194 can rotationally interlock with the at least one protuberances 320 of the suppressor cap 120, as described in greater detail below with respect to FIGS. 5-7.

Specifically, the distances 339,349 can be sized complimentary to the outer rail width 280 (shown in FIG. 2) for one or more examples of the firearm 190. For example and without limitation, the first distance 339 can be sized complimentary to the outer rail width 280 of a first example of the firearm 190, and the second distance 349 can be sized complimentary to the outer rail width 280 of a second example of the firearm 190, which can be different from the outer rail width 280 of the first example of the firearm 190. In some aspects, the first distance 339 can be sized equivalent to the second distance 349.

The various widths 325,327,335,347 can be sized complimentary to the inner rail width 290 (shown in FIG. 2) for one or more examples of the firearm 190. For example and without limitation, in some aspects, the width 327 and/or the width 347 can be sized complimentary to the inner rail width 290 of the first example of the firearm 190, and the width 325 and/or the width 335 can be sized complimentary to the inner rail width 290 of the second example of the firearm 190, which can be different from the inner rail width 290 of the first example of the firearm 190. Such an arrangement can maximize surface area of engagement between the suppressor cap 120 and the slide 194 by providing contact with both the outer surfaces 216,218 (shown in FIG. 2) and the inner surfaces 236,238 (shown in FIG. 2) of the slide 194.

In some aspects, the widths 325,327,335,347 can be sized to engage with a third and a fourth example of the firearm 190, which can be distinct from the first and second examples of the firearm 190. For example and without limitation, the width 325 and the width 335 can be respectively sized complimentary to the inner rail width 290 of a third example of the firearm 190 and a fourth example of the firearm 190. Such an arrangement can increase compatibility of the suppressor cap 120 to rotationally interlock with the slides 194 of more different examples of the firearm 190.

In some aspects, the first distance 339, the second distance 349, or both distances 339,349 can be between 0.848" and 0.893". In some aspects, the first distance 339, the second distance 349, or both distances 339,349 can be between 0.853" and 0.888". In some aspects, the first distance 339, the second distance 349, or both distances 339,349 can be between 0.858" and 0.883". In some aspects, the first distance 339, the second distance 349, or both distances 339, 349 can be between 0.863" and 0.878". In some aspects, the first distance 339, the second distance 349, or both distances 339,349 can be between 0.868" to 0.873".

In some aspects, the first distance 339, the second distance 349, or both distances 339,349 can be between 0.985" and 1.030". In some aspects, the first distance 339, the second distance 349, or both distances 339,349 can be between 0.990" and 1.025". In some aspects, the first distance 339, the second distance 349, or both distances 339,349 can be between 0.995" and 1.020". In some aspects, the first distance 339, the second distance 349, or both distances 339, 349 can be between 1.000" and 1.015". In some aspects, the first distance 339, the second distance 349, or both distances 339,349 can be between 1.005" and 1.010".

In some aspects, the first distance 339, the second distance 349, or both distances 339,349 can be between 0.843" and 0.888". In some aspects, the first distance 339, the second distance 349, or both distances 339,349 can be between 0.848" and 0.883". In some aspects, the first distance 339, the second distance 349, or both distances 339,349 can be between 0.853" and 0.878". In some aspects, the first distance 339, the second distance 349, or both distances 339, 349 can be between 0.858" and 0.873". In some aspects, the first distance 339, the second distance 349, or both distances 339,349 can be between 0.863" and 0.868".

In some aspects, the first distance 339, the second distance 349, or both distances 339,349 can be between 1.100" and 1.145". In some aspects, the first distance 339, the second distance 349, or both distances 339,349 can be between 1.105" and 1.140". In some aspects, the first distance 339, the second distance 349, or both distances 339,349 can be between 1.110" and 1.135". In some aspects, the first distance 339, the second distance 349, or both distances 339, 349 can be between 1.115" and 1.130". In some aspects, the first distance 339, the second distance 349, or both distances 339,349 can be between 1.120" and 1.125".

In some aspects, any or all of the widths 325,327,335,347 can be between 0.590" and 0.635". In some aspects, any or all of the widths 325,327,335,347 can be between 0.595" and 0.630". In some aspects, any or all of the widths 325,327,335,347 can be between 0.600" and 0.625". In some aspects, any or all of the widths 325,327,335,347 can be between 0.605" and 0.620". In some aspects, any or all of the widths 325,327,335,347 can be between 0.610" and 0.615".

In some aspects, any or all of the widths 325,327,335,347 can be between 0.518" and 0.563". In some aspects, any or all of the widths 325,327,335,347 can be between 0.523" and 0.558". In some aspects, any or all of the widths 325,327,335,347 can be between 0.528" and 0.553". In some aspects, any or all of the widths 325,327,335,347 can be between 0.533" and 0.548". In some aspects, any or all of the widths 325,327,335,347 can be between 0.538" and 0.543".

In some aspects, any or all of the widths 325,327,335,347 can be between 0.764" and 0.809". In some aspects, any or all of the widths 325,327,335,347 can be between 0.769" and 0.804". In some aspects, any or all of the widths 325,327,335,347 can be between 0.774" and 0.799". In some aspects, any or all of the widths 325,327,335,347 can be between 0.779" and 0.794". In some aspects, any or all of the widths 325,327,335,347 can be between 0.784" and 0.789".

In some aspects, any or all of the widths 325,327,335,347 can be between 0.632" and 0.677". In some aspects, any or all of the widths 325,327,335,347 can be between 0.637" and 0.672". In some aspects, any or all of the widths 325,327,335,347 can be between 0.642" and 0.667". In some aspects, any or all of the widths 325,327,335,347 can be between 0.647" and 0.662". In some aspects, any or all of the widths 325,327,335,347 can be between 0.652" and 0.657".

In some aspects, any or all of the widths 325,327,335,347 can be between 0.7685" and 0.8135". In some aspects, any or all of the widths 325,327,335,347 can be between 0.7735" and 0.8085". In some aspects, any or all of the widths 325,327,335,347 can be between 0.7785" and 0.8035". In some aspects, any or all of the widths 325,327,335,347 can be between 0.7835" and 0.7985". In some aspects, any or all of the widths 325,327,335,347 can be between 0.7885" and 0.7935".

FIG. 4 shows the suppressor cap 120 uncoupled from the first tube end 135 of the tube 130. In the present aspect, the suppressor cap 120 can be coupled to the tube 130 via threaded engagement. The tube 130 can define internal threading 430 at the first tube end 135. The suppressor cap 120 can comprise a tubular portion 420 extending axially away from the flange 310, opposite from the at least one protuberance 320. The tubular portion 420 can be substantially cylindrical in shape. The suppressor cap 120 can further comprise external threading 422, which can extend radially outward from the tubular portion 420 with respect to the axis 314. The external threading 422 can be engaged with the internal threading 430 of the tube 130 to couple the suppressor cap 120 to the tube 130.

Figure 5:
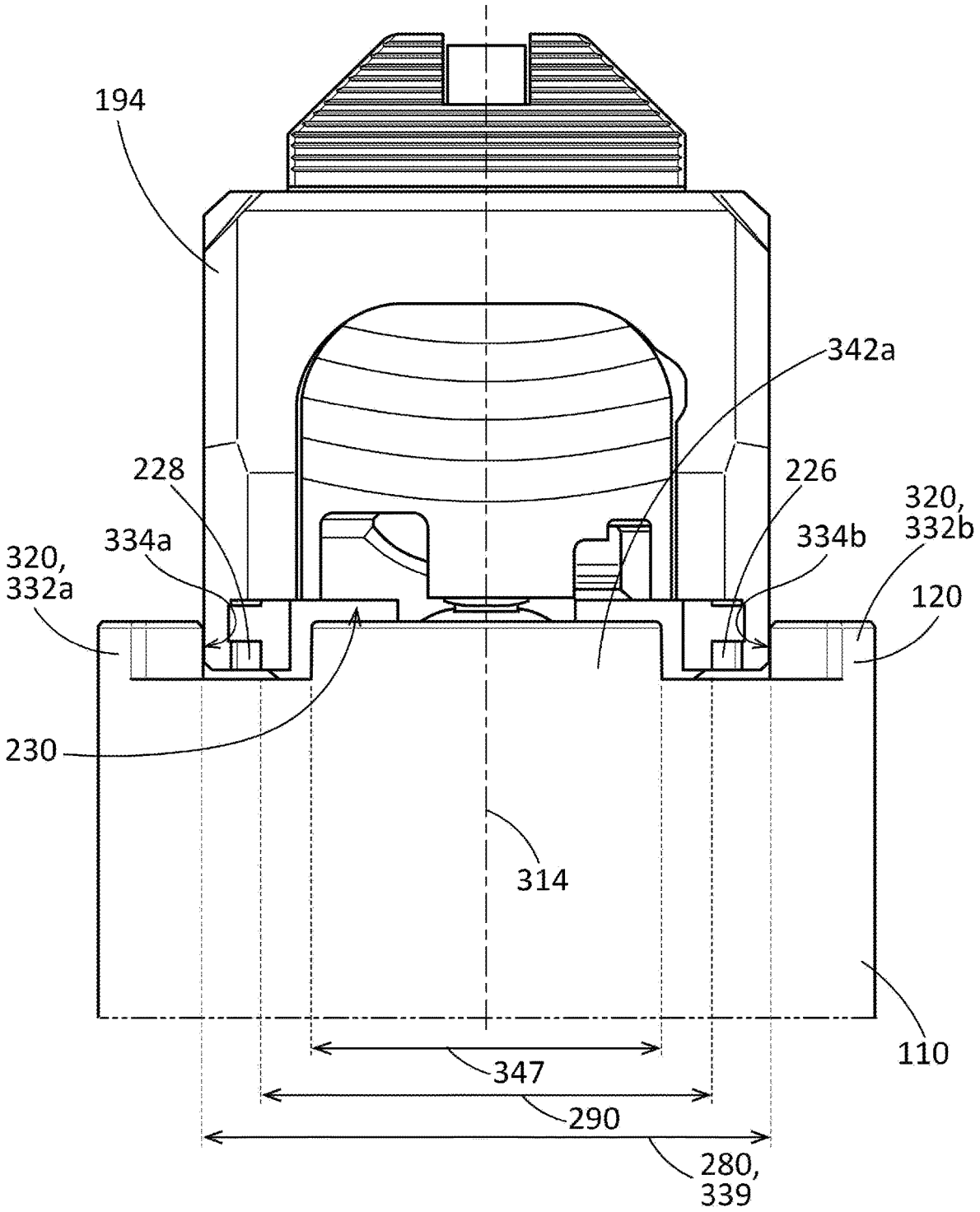
FIG. 5 is a rear view of the slide of the firearm of FIG. 1 engaged with the suppressor cap of the suppressor of FIG. 1.
Figure 6:
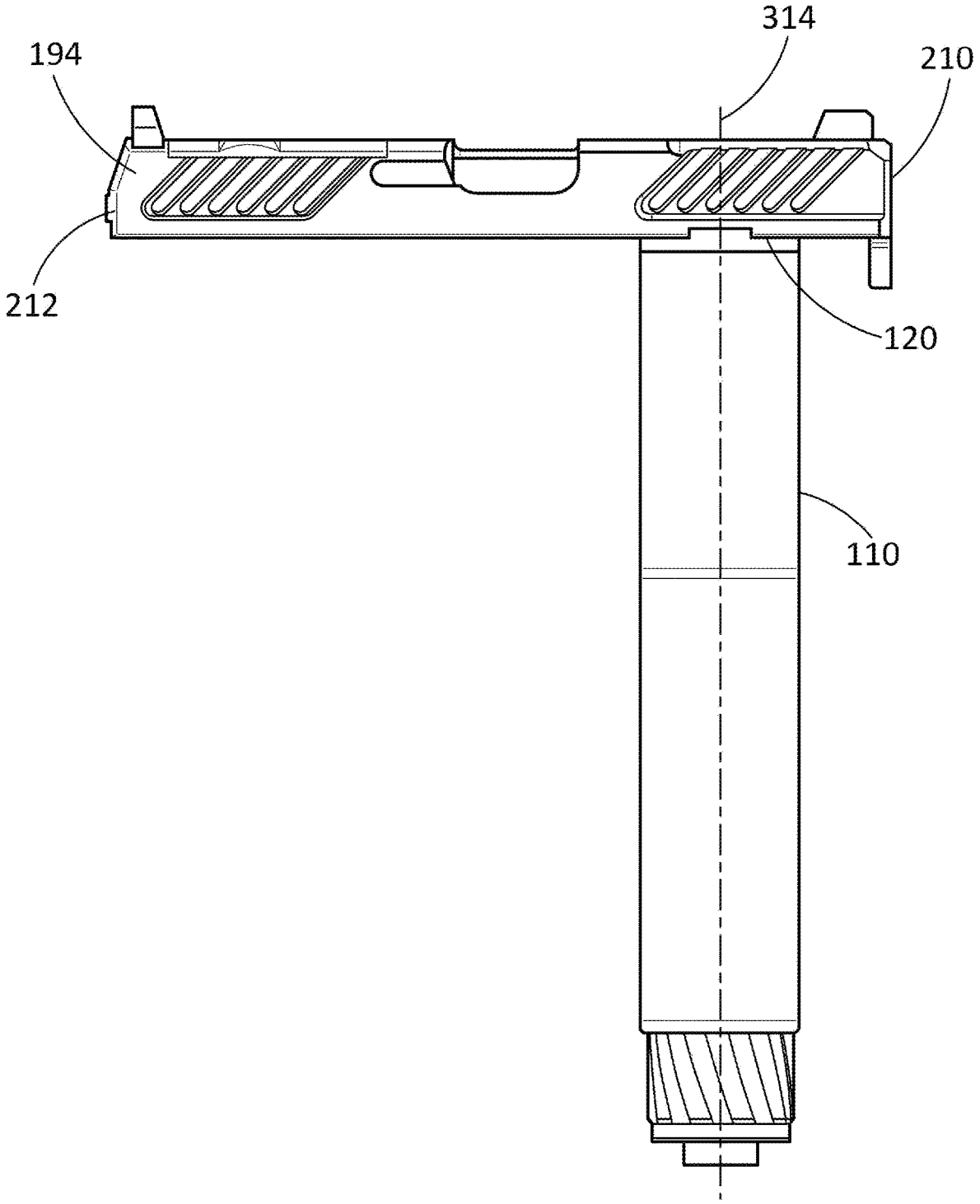
FIG. 6 is a side view of the slide of the firearm of FIG. 1 engaged with the suppressor cap of the suppressor of FIG. 1.
Figure 7:
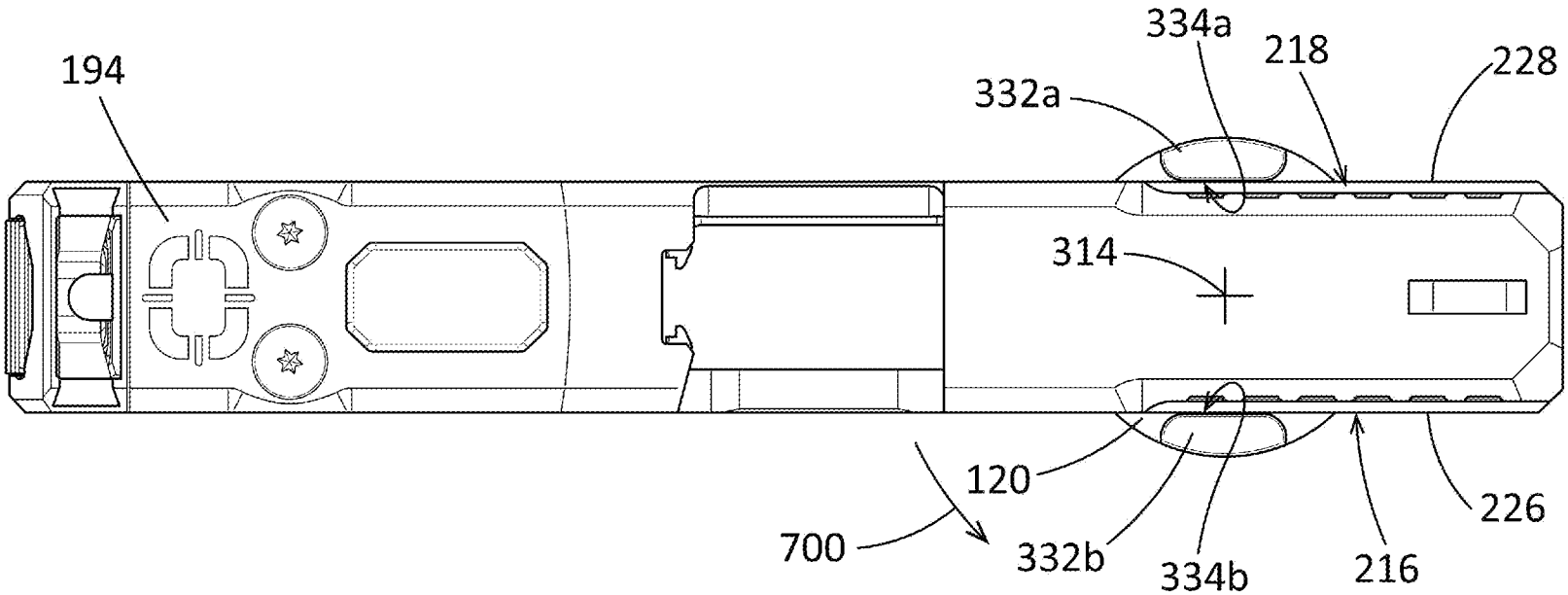
FIG. 7 is a top view of the slide of the firearm of FIG. 1 engaged with the suppressor cap of the suppressor of FIG. 1.

FIGS. 5-7 demonstrate how the slide 194 can rotationally interlock with the at least one protuberance 320 of the suppressor cap 120 and how the slide 194 can be used as a tool to uncouple the suppressor cap 120 from the tube 130.

FIG. 5 is a rear view of the slide 194 rotationally interlocked with the suppressor cap 120 of the suppressor 110 about the axis 314. To interlock the slide 194 with the suppressor cap 120, the slide rails 226,228 can be engaged with the at least one protuberance 320. In the aspect shown, the first distance 339 between the first pair of lugs 332*a*,*b* is sized complimentary to the outer rail width 280 such that the slide rails 226,228 closely interface with the first pair of lugs 332*a,b*. Specifically, the slide rails 226,228 can contact the first pair of radially inner surfaces 334*a,b* of the first pair of lugs 332*a,b* (see also FIG. 7, wherein the outer surfaces 216,218 of the slide rails 226,228 are shown contacting the first pair of radially inner surfaces 334*a,b* of the first pair of lugs 332*a,b*).

The center lug 322 (shown in FIG. 3) and the second pair of lugs 342*a,b* (lug 342*b* shown in FIG. 3) can extend into the channel 230 of the slide 194. In some aspects, the width 327 (shown in FIG. 3) of the center lug 322 and/or the width 347 of the second pair of lugs 342*a,b* can be sized complimentary to the inner rail width 290 such that the slide rails 226,228 closely interface with the center lug 322 and/or the second pair of lugs 332*a,b*, either in addition to or in place of engagement between the slide rails 226,228 and the first pair of lugs 332*a,b*.

FIG. 6 is a side view of the slide 194 rotationally interlocked with the suppressor cap 120 of the suppressor 110 about the axis 314.

With the slide 194 rotationally interlocked with the suppressor cap 120, the first end 210 and the second end 212 of the slide 194 can overhang from the suppressor cap 120, and the slide 194 can be used as a tool, such as a wrench, to provide leverage to rotate the suppressor cap 120 about the axis 314 and unscrew the suppressor cap 120 from the tube 130, as shown in FIG. 6.

FIG. 7 shows the slide 194 being rotated in a counterclockwise direction 700 (with respect to the viewing angle) about the axis 314 (shown extending out of the page) to loosen and remove the suppressor cap 120 from the remainder of the suppressor 110. The rotational direction should not be viewed as limiting. The suppressor cap 120 and the tube 130 can utilize right-handed or left-handed threads in various aspects. By using the slide 194 as a wrench, a user can exert more torque on the suppressor cap 120 than would be possible with hand strength, alone, without requiring the use of tools. The slide 194 can also be utilized as a tool to tighten the suppressor cap 120 to the tube 130.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A suppressed firearm comprising:

a firearm comprising a slide; and a suppressor configured to mount to the firearm, the suppressor comprising a suppressor cap, the suppressor cap defining at least one protuberance configured to engage with at least one portion of the slide for rotating the suppressor cap relative to the suppressor, wherein the at least one protuberance is spaced from the slide when the suppressor is mounted to the firearm.

2. The suppressed firearm of claim 1, wherein:

the suppressor defines a first end and a second end;

the suppressor cap is positioned at the first end;

the second end is configured to mount to the firearm;

an axis extends from the first end to the second end; and the at least one protuberance is configured to rotationally interlock with the slide about the axis.

3. A suppressed firearm comprising:

a firearm comprising a slide; and a suppressor configured to mount to the firearm, the suppressor comprising a suppressor cap, the suppressor cap defining at least one protuberance configured to rotationally interlock with the slide, wherein:

the at least one protuberance comprises a first lug and a second lug; and a distance between the first lug and the second lug is sized complimentary to an outer rail width of the slide.

4. The suppressed firearm of claim 3, wherein:

the slide defines an inner rail width;

the at least one protuberance further comprises a third lug and a fourth lug; and the third lug and the fourth lug each define a width that is sized complimentary to the inner rail width.

5. The suppressed firearm of claim 3, wherein:

the slide defines an inner rail width;

the at least one protuberance further comprises a center lug; and the center lug defines a center lug width that is sized complimentary to the inner rail width.

6. A suppressed firearm comprising:

a firearm comprising a slide; and a suppressor configured to mount to the firearm, the suppressor comprising a suppressor cap, the suppressor cap defining at least one protuberance configured to rotationally interlock with the slide, wherein the suppressor cap further comprises a flange defining a through hole, the through hole defining an axis, and wherein the at least one protuberance of the suppressor cap includes a first lug extending axially outward from the flange, the first lug defining a first radially inner surface, and a second lug extending axially outward from the flange, the second lug defining a second radially inner surface positioned parallel to the first radially inner surface, the axis centered between the first radially inner surface and the second radially inner surface.

7. The suppressed firearm of claim 6, wherein the first radially inner surface and the second radially inner surface are planar.

8. The suppressed firearm of claim 6, wherein the flange defines a circumference, and wherein the first lug and the second lug are positioned adjacent to the circumference.

9. The suppressed firearm of claim 6, wherein a distance between the first radially inner surface and the second radially inner surface is between 0.848 inches and 0.893 inches.

10. The suppressed firearm of claim 9, wherein:

the at least one protuberance further includes a third lug and a fourth lug;

the third lug defines a third radially inner surface;

the fourth lug defines a fourth radially inner surface; and a distance between the third radially inner surface and the fourth radially inner surface is between 0.985 inches and 1.030 inches.

11. The suppressed firearm of claim 10, wherein the third radially inner surface is perpendicular to the first radially inner surface.

12. The suppressed firearm of claim 6, wherein a distance between the first radially inner surface and the second radially inner surface is between 0.985 inches and 1.030 inches.

13. The suppressed firearm of claim 6, wherein the first lug defines a width between 0.764 inches and 0.809 inches.

14. The suppressed firearm of claim 6, wherein the first lug defines a width between 0.632 inches and 0.677 inches.

15. The suppressed firearm of claim 6, wherein a distance between the first radially inner surface and the second radially inner surface is between 0.843 inches and 0.888 inches.

16. The suppressed firearm of claim 6, wherein a distance between the first radially inner surface and the second radially inner surface is between 1.100 inches and 1.145 inches.

17. The suppressed firearm of claim 6, wherein the first lug defines a width between 0.768 inches and 0.814 inches.

* * * * *